United States Patent [19]

Seike et al.

[11] Patent Number: 4,835,508

[45] Date of Patent: May 30, 1989

[54] ZINC OXIDE TYPE LIGHTNING-CONDUCTING ELEMENT

[75] Inventors: Shoji Seike; Takao Totoki, both of Nagoya; Masayuki Nozaki, Ama, all of Japan

[73] Assignee: NGK Insulators, Ltd., Japan

[21] Appl. No.: 112,275

[22] Filed: Oct. 26, 1987

[30] Foreign Application Priority Data

Feb. 26, 1987 [JP] Japan ..... 62-41449

[51] Int. Cl.[4] ..... H01C 3/04

[52] U.S. Cl. ..... 338/21; 338/308

[58] Field of Search ..... 338/21, 308; 252/518

[56] References Cited

U.S. PATENT DOCUMENTS 4,460,497 7/1984 Gupta et al. ..... 338/21 X

OTHER PUBLICATIONS

Japanese Patent Appln. Laid-Open No. 57-169,204, Oct. 10, 1982.

Japanese Patent Appln. Laid-Open No. 57-38,503, Mar. 4, 1982.

Japanese Patent Appln. Laid-Open No. 61-206,202, 9/12/86.

Japanese Patent Appln. Laid-Open No. 61-59,702, 3/27/86.

Japanese Patent Appln. Laid-Open No. 61-81,602, 4/25/86.

*Primary Examiner*—E. A. Goldberg
*Assistant Examiner*—M. M. Lateef
*Attorney, Agent, or Firm*—Arnold, White & Durkee

[57] ABSTRACT

A zinc oxide lightning-conducting element is disclosed which includes a metal oxide sintered body mainly composed of zinc oxide, and electrodes which consist of metal vapor-deposited films provided on opposite surfaces of the sintered body in a thickness of not less than 300 Å and noble metal coat films coated onto the metal vapor-deposited films. At least one kind of a metal oxide is added and mixed into the zinc oxide.

15 Claims, 3 Drawing Sheets

ZINC OXIDE TYPE LIGHTNING-CONDUCTING ELEMENT

BACKGROUND OF THE INVENTION

1 Field of the Invention:

The present invention relates to a zinc oxide type lightning-conducting element with electrodes having excellent properties.

2 Related Art Statement:

As conventional lightning-conducting elements mainly composed of zinc oxide for protecting insulators from high voltage surge due to lighting, has been is known, as sectionally shown in FIG. 3, that electrodes 12, made of such materials as aluminum, are formed on opposite surfaces of a ZnO element 11 by a metal flame spraying process. The ZnO elements 11 is a metal oxide sintered body which mainly consists of zinc oxide and at least one kind of metal oxide additive.

In the above-constituted zinc oxide type lightning-conducting elements, the metal flame-sprayed electrodes 12 reduce a contact resistance in piled lightning-conducting elements and uniformly distribute current flowing inside the lightning-conducting elements.

The metal flame-sprayed electrodes 12 used as electrodes in the above-mentioned conventional zinc oxide type lightning-conducting have large sprayed particles and as a result, portions at which the electrode does not contact the ZnO element 11 are formed to a cerain degree at uneven surface portions thereof. Consequently, when the lightning-conducting element operates due to a great current surge such as a lightning impulse current, discharge locally occurs and current does not uniformly flow through the ZnO element 11. Consequently, the essential characteristics of the ZnO element cannot fully be exhibited and the lightning-conducting element may be broken even under a low surge current.

Japanese patent application Laid-open No. 61-171,102 discloses a technique for uniformly forming metal electrodes of fine particles on surfaces of a ZnO element by vapor deposition. However, the electrode on the surface of the ZnO element is broken due to surge currents unless the electrode has a thickness of larger than 5 to 10 μm, so that a stable effect cannot be attained. On the other hand, it is economically difficult to obtain a thickness of not less than 5 to 10 μm by vapor deposition only. Therefore, satisfactory performances as the lightning-conducting elements could not be obtained.

SUMMARY OF THE INVENTION

It is an object of the present invention to obviate the above-mentioned drawbacks, and to provide zinc oxide type lightning-conducting elements which have excellent adhesion between a ZnO element and electrodes formed thereon and exhibit high lightning surge performances.

The zinc oxide type lightning-conducting element according to the present invention comprises a metal oxide sintered body which is mainly composed of zinc oxide to which is added and mixed at least one kind of a metal oxide, and electrodes which consist of metal vapor-deposited films formed on each of opposed surfaces of the metal oxide sintered body in a thickness of not less than 300 Å and coated films of a noble metal formed on the respective metal vapor-deposited films.

In the above-mentioned construction, the metal vapor-deposited film, preferably, a gold vapor-deposited film, is formed on each of the opposed surfaces of the ZnO element in a thickness of not less than 300 Å, a noble metal paste, preferably a silver paste, is coated onto the vapor-deposited film to in a thickness of 10 to 20 μm, and then the coated $ZnO_2$ element is fired at, for instance, 500° C. Thereby, a coated film made of the noble metal, preferably silver, is formed. Thus, the electrode having a necessary thickness can inexpensively and uniformly be formed on the surfaces of the ZnO element. As a result, current uniformly flows through the element to largely improve the surge characteristics.

These and other objects, features, and advantages of the invention will be appreciated upon reading of the invention when taken in conjunction with the attached drawings, with understanding that some modifications, variations and changes of same could be made by the skilled person in the art to which the invention pertains without departing from the spirit of the invention or the scope of claims appended hereto.

BRIEF DESCRIPTION OF THE ATTACHED DRAWINGS

For a better understanding of the invention, reference is made to the attached drawings, wherein:

FIGS. 1(*a*), (*b*) and (*c*) are sectional views illustrating a sequence of producing a lightning-conducting element according to the present invention;

FIGS. 2(*a*), (*b*) and (*c*) are SEM photographs showing crystalline structures of a comparative example, an invention example, and a conventional example, respectively; and FIG. 3 is a sectional view showing a structure of a conventional lightning-conducting element.

DETAILED DESCRIPTION OF THE INVENTION

The present invention will be described in the following with reference to the attached drawings.

In the present invention, the reason why the thickness of the metal vapor-deposited film formed on the surface of the ZnO element is restricted to not less than 300 Å is that if it is less than 300 Å, its effect for stably adhering the outer noble metal coated film to the ZnO element is small.

The reason why the average length of the non-contact portion between the ZnO element and the electrode is preferably 10 μm or less per 100 μm at an arbitrary section location is that if the non-contact portion excess 10 μm per 100 μm, the adhesion becomes poorer so that stable surge characteristic cannot be obtained.

Further, the reason why the combination of the gold vapor-deposited film and the silver coat film obtained from the silver paste through firing is preferable is that such a combination is readily available, the silver and gold have excellent adhesion to each other and the combination is inexpensive.

In the following, the present invention will be explained in more detail with reference to examples, comparative examples and prior art example. However, the examples are merely illustrative of the invention, and should never be interpreted to limit the scope thereof.

Desired metal oxide sintered bodies mainly composed of zinc oxide (ZnO elements) are obtained as follows:

First, at least one kind of a metal oxide having been adjusted in a desired grain size and being selected from $Bi_2O_3$, $Co_2O_3$, $MnO_2$, $Sb_2O_3$, $Cr_2O_3$, $SiO_2$ and NiO is mixed into a zinc oxide starting material having been adjusted in a desired particle size together with a sintering aid such as polyvinyl alcohol, which is granulated, and molded. A thus obtained molding was preliminarily fired to scatter and remove the sintering aid, and then finally sintered, thereby obtaining a desired sintered body.

Figure 1A:
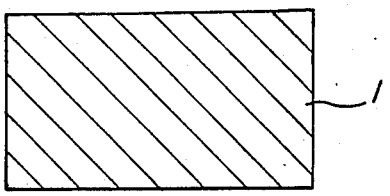
Figure 1B:
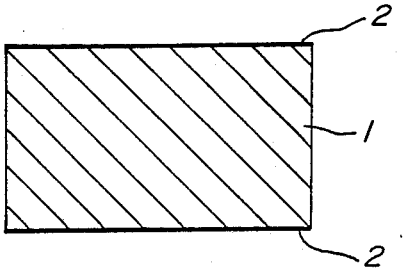
Figure 1C:
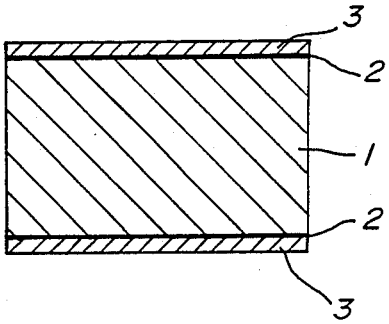

Next, opposite surfaces of the thus obtained metal oxide sintered body 1 shown in FIG. 1(*a*) are smoothly ground, and then a metal vapor-deposited film 2, preferably of gold, is formed thereon in a certain thickness of not less than 300 Å as shown in FIG. 1(*b*). Finally, as shown in FIG. 1(*c*), a noble metal paste 3, preferably made of silver, is coated onto the metal vapor-deposited film 2 in a thickness of 10 to 20 μm. Then, the thus coated ZnO element is fired at temperatures, for instance, around 500 ° C., thereby obtaining a desired zinc oxide type lightning-conducting element.

Now, actual examples of the present invention will be explained.

By using metal oxide sintered bodies having the same shape as obtained in the above process, zinc oxide type lightning elements were prepared in Run Nos. 1–5 according to the present invention and Run Nos. 6–8 as comparative examples which each had electrodes consisting of a metal vapor-deposited film and a noble metal coat film under conditions shown in Table 1, and Run No. 9 as a conventional example to which electrode was formed by flame spraying an aluminum in a thickness of from 30 to 50 μm.

With respect to each of thus prepared Run Nos. 1–9, switching surge tolerance was evaluated by applying currents shown in Table 1 to three lightning-conducting elements as 20 times at an interval of 2 minutes. A length of a non-contact portion per a given length of sectional length of the lightning element was determined by observing an electrode-coated portion with a scanning type electron microscope (SEM). In Table 1, "O" denotes a case where the test sample was not broken even at 20 applications of the current, and "X" denotes a case where the test sample was broken during the test. Further, the length of the non-contacted portion was expressed per 100 μm of the sectional length.

TABLE 1

| | | | Present Invention | | | | | Comparative Example | | | Conventional example |
|---|---|---|---|---|---|---|---|---|---|---|---|
| Test run No. | | | 1 | 2 | 3 | 4 | 5 | 6 | 7 | 8 | 9 |
| Conducting electrodes | Vapor depositing conditions | Thickness of vapor-deposited film (Å) (material) | 300 (Au) | 400 (Au) | 300 (Au—Pd) | 300 (Au) | 300 (Pt—Pd) | 200 (Au) | 10000 (Au) | — | — |
| | | Vapor-depositing time (min.) | 5 | 7 | 5 | 5 | 5 | 4 | 180 | — | — |
| | Coating conditions | Material | Ag paste | Ag paste | Ag paste | Ag—Pd paste | Ag—Pd paste | Ag paste | — | Ag paste | — |
| | | Coating method | screen | screen | screen | screen | screen | screen | — | screen | — |
| | | Thickness (μm) | 10~20 | 10~20 | 10~30 | 10~30 | 10~20 | 10~20 | — | 10~30 | — |
| | Aluminum metal flame-spraying (μm) | | — | — | — | — | — | — | — | — | 30~50 |
| Switching surge tolerance (A) | | 1100 | X O O | O O X | O X X | O X O | X X O | | | | |
| | | 1000 | O O O | O O O | O O O | O O O | O O O | X X | | | |
| | | 900 | O O O | O O O | O O O | O O O | O O O | O X O | | | X X |
| | | 800 | O O O | O O O | O O O | O O O | O O O | O O O | | | O O X |
| | | 700 | O O O | O O O | O O O | O O O | O O O | O O O | | | O O O |
| | | 600 | O O O | O O O | O O O | O O O | O O O | O O O | X | X | O O O |
| | | 500 | O O O | O O O | O O O | O O O | O O O | O O O | X O X | O X X | O O O |
| | | 400 | | | | | | | O O O | O O O | |
| | | 300 | | | | | | | O O O | O O O | |
| | | 200 | | | | | | | O O O | O O O | |
| | | 100 | | | | | | | O O O | | |
| Length of non-contact portion (μm)/100 μm | | | <<10 | <<10 | <<10 | <<10 | <<10 | >10 | 0 | >50 | >20 |

As obvious from Table 1, Run Nos. 1 through 5 according to the present invention in which the thickness of the metal vapor-deposited film was not less than 300 Å and a noble metal paste was used could tolerate 20 switching surge-applying tests even at 1000 ampere, while no samples in Run No. 6 having not more than 300 Å of the metal vapor-deposited film could tolerate the switching surge-applying test at 1000 ampere.

It was confirmed that Run No. 7 with a gold vapor-deposited film only as an electrode and Run No. 8 with a silver coat film only could not obtain a high switching surge tolerance.

Furthermore, conventional Run No. 9 using aluminum metal flame-sprayed as an electrodes could not tolerate a switching surge-applying test at 800 ampere, and was inferior to Run Nos. 1 to 5 of the present invention in this respect.

In Run Nos. 1 and 2 according to the present invention, the length of the non-contact portion is not more than 10 μm per 100 μm of the sectional length. On the other hand, in the other comparative examples and the conventional example, is exceeds 10 μm/100 μm. Thus, it is understood that the length of the non-contact portion is preferably not less than 10 μm per 100 μm of the sectional length.

Figure 2A:
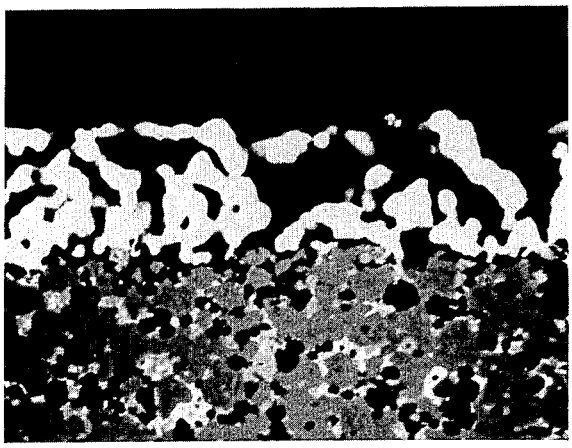
Figure 2B:
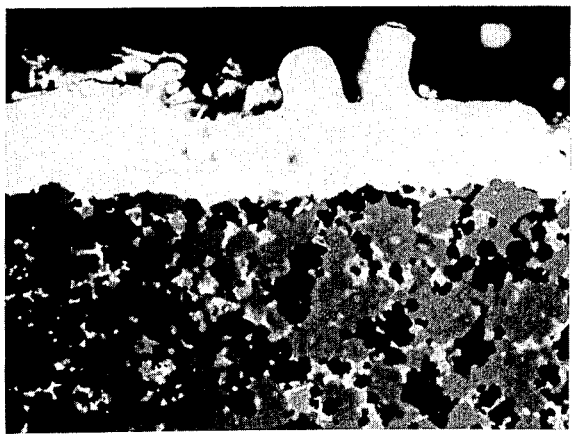
Figure 2C:
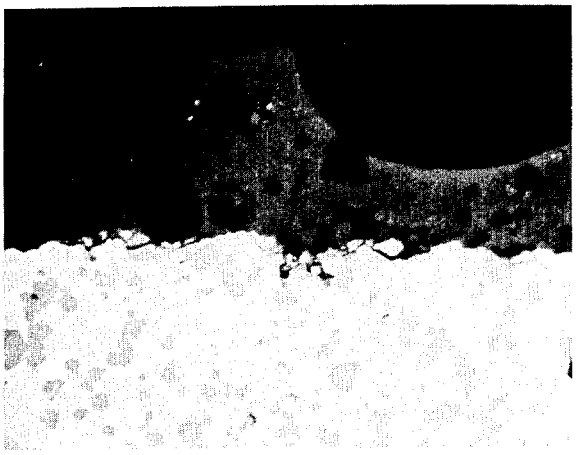
Figure 3:
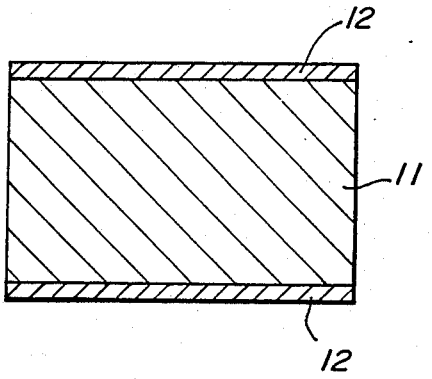
FIG. 3 PRIOR ART

FIGS. 2(*a*) through (*c*) respectively show photographs of electrode-applied portions of Run No. 8 as a comparative example Run No. 1 according to the present invention, and Run No. 9 as a conventional example as viewed by a scanning type electron micorscope (SEM). It is seen from the SEM photograph of Run No.

1 according to the present invention in FIG. 2(*b*) that the white noble metal vapor-deposited film and the metal oxide sintered body completely adhere to each other, while it is also seen from the SEM photograph of Run No. 8 shown in FIG. 2(*a*) and that of Run No. 9 shown in FIG. 2(*c*) that black non-contact portions exist in the interface.

As evident from the above-detailed explanation, according to the zinc oxide type lightning-conducting element of the present invention, a desired thickness of the electrode can be inexpensively and uniformly formed on the surface of the metal oxide sintered body (ZnO element) by constituting the electrodes with the metal vapor-deposited film and the noble metal coat film. As a result, the current uniformly flows through the electrode and the surge characteristic can largely be improved.

What is claimed is:

1. A zinc oxide lightning-conducting element comprising:

a metal oxide sintered body mainly composed of zinc oxide added and mixed with at least one metal oxide; and electrodes formed on opposite surfaces of said metal oxide sintered body, said electrodes consisting of metal vapor-deposited films formed directly on said opposite surfaces to a thickness of not less than 300 Å, and noble metal films coated on said metal vapor-deposited films.

2. A zinc oxide lightning-conducting element according to claim 1, wherein an average non-contact portion at an interface between said metal oxide sintered body and said electrodes is not more than 10 μm per 100 μm of any sectional length of said interface.

3. A zinc oxide lightning-conducting element according to claim 1, wherein said metal vapor-deposited films are made of gold and said noble metal films are formed by firing a silver paste.

4. A zinc oxide lightning-conducting element according to claim 1, wherein said at least one metal oxide is selected from the group consisting of $Bi_2O_3$, $Co_2O_3$, $MnO_2$, $Sb_2O_3$, $Cr_2O_3$, $SiO_2$ and Ni0.

5. A zinc oxide lightning-conducting element according to claim 1, wherein said metal vapor-deposited films are made of at least one material selected from the group consisting of Au-Pd and Pt-Pd, and said noble metal films are formed by firing an Ag-Pd paste.

6. A zinc oxide lightning conducting element comprising:

a metal oxide sintered body mainly composed of zinc oxide added and mixed with at least one metal oxide; and electrodes formed on opposite surfaces of said metal oxide sintered body, said electrodes consisting of metal vapor-deposited films formed directly on said opposite surfaces to a thickness of not less than 300 Å, and noble metal films screen printed on said metal vapor-deposited films to a thickness of about 10–30 microns.

7. A zinc oxide lightning-conducting element according to claim 6, wherein an average non-contact portion at an interface between said metal oxide sintered body and said electrodes is not more than 10 μm per 100 μm of any sectional length of said interface.

8. A zinc oxide lightning-conducting element according to claim 6, wherein said metal vapor-deposited films are made of gold and said noble metal films are formed by firing a silver paste.

9. A zinc oxide lightning-conducting element according to claim 6, wherein said at least one metal oxide is selected from the group consisting of $Bi_2O_3$, $Co_2O_3$, $MnO_2$, $Sb_2O_3$, $Cr_2O_3$, $SiO_2$ and NiO.

10. A zinc oxide lightning-conducting element according to claim 6, wherein said metal vapor-deposited films are made of at least one material selected from the group consisting of Au-Pd and Pt-Pd, and said noble metal films are formed by firing an Ag-Pd paste.

11. A zinc oxide lightning conducting element comprising:

a metal oxide sintered body mainly composed of zinc oxide added and mixed with at least one metal oxide; and electrodes formed on opposite surfaces of said metal oxide sintered body, said electrodes consisting of metal vapor-deposited films formed directly on said opposite surfaces and noble metal films coated on said metal vapor-deposited films.

12. A zinc oxide lightning-conducting element according to claim 11, wherein an average non-contact portion at an interface between said metal oxide sintered body and said electrodes is not more than 10 μm per 100 μm of any sectional length of said interface.

13. A zinc oxide lightning-conducting element according to claim 11, wherein said metal vapor-deposited films are made of gold and said noble metal films are formed by firing a silver paste.

14. A zinc oxide lightning-conducting element according to claim 11, wherein said at least one metal oxide is selected from the group consisting of $Bi_2O_3$, $Co_2O_3$, $MnO_2$, $Sb_2O_3$, $Cr_2O_3$, $SiO_2$ NiO.

15. A zinc oxide lightning-conducting element according to claim 11, wherein said metal vapor-deposited films are made of at least one material selected from the group consisting of Au-Pd and Pt-Pd, and said noble metal films are formed by firing an Ag-Pd paste.

* * * * *